US006477884B1

(12) United States Patent
Berntsen

(10) Patent No.: US 6,477,884 B1
(45) Date of Patent: Nov. 12, 2002

(54) RECIPROCATING SAW BLADE REPAIR DEVICE

(76) Inventor: Kenneth Berntsen, 469 First Ave., Bayport, NY (US) 11705

( * ) Notice: Subject to any disclaimer, the term of this patent is extended or adjusted under 35 U.S.C. 154(b) by 0 days.

(21) Appl. No.: 09/861,375

(22) Filed: May 18, 2001

(51) Int. Cl.[7] ..... B21D 28/32

(52) U.S. Cl. ..... 72/409.16; 81/352; 81/383; 81/463; 76/25.1; 83/681

(58) Field of Search ..... 72/409.08, 409.01, 72/409.16; 76/25.1; 81/373, 342, 352, 381, 383, 463; 83/632, 626, 681

(56) References Cited

U.S. PATENT DOCUMENTS 2,679,779 A * 6/1954 Spikings ..... 81/373
3,475,946 A * 11/1969 Laux ..... 72/409.01
3,842,650 A * 10/1974 Hartmeister ..... 30/250
4,120,303 A * 10/1978 Villa-Massone et al. ..... 81/323
4,336,725 A * 6/1982 Patterson ..... 76/25.1
4,729,170 A * 3/1988 Hartmeister ..... 72/409.1
4,825,735 A * 5/1989 Undin ..... 81/313
RE33,714 E * 10/1991 Anderson et al. ..... 81/467
5,377,415 A * 1/1995 Gibson ..... 30/358
6,065,376 A * 5/2000 Khachatoorian ..... 81/341

* cited by examiner

*Primary Examiner*—Daniel C. Crane
(74) *Attorney, Agent, or Firm*—John D. Gugliotta

(57) ABSTRACT

A lightweight, versatile device is provided that can change from a hand held device to a bench top device that reshapes the broken end of a reciprocating saw blade and punches the necessary hole in said blade, thus allowing the blade to be reused.

4 Claims, 5 Drawing Sheets

RECIPROCATING SAW BLADE REPAIR DEVICE

BACKGROUND OF THE INVENTION

1. Field of the Invention

The present invention relates generally to punch presses and, more particularly, to a lightweight, portable punch press with the capability of being hand-held, used for the repair of broken reciprocating saw blades.

2. Description of the Related Art

As is well known, the reciprocating saw is a multipurpose cutting device used throughout the construction industry, as well as by many nonprofessional home repair persons. The device consists of an electric motor that powers a blade in a reciprocating path to allow cutting in close quarters. The blade is secured at one end of the saw's housing, and comprises an elongated member which protrudes from the device's housing. This protrusion allows substantial torque to be placed on the point of connection of the blade. Furthermore, because the saw is designed to cut a wide variety of materials at numerous angles, having blades sheer at the connection point is common. Reciprocating saw blade ends have a unique curved configuration with a penetration at the middle, by which the blade is connected to the saw. Since the blade usually breaks right in front of this connection, the blade's end must be reformed in order to reconnect the remaining blade to the saw.

Broken blades are a significant problem for reciprocating saw users. In the past, trips to the hardware store to purchase new blades were the only option for them. This is time consuming, aggravating and expensive, not only to buy and replace the blades, but also for the time such a task takes away from laborers.

Another problem with reciprocating saw blades is the prospect of purchasing the wrong size blade. Once again, this necessitates a trip to the hardware store, causing lost work time, inconvenience and expense.

A device, therefore, is needed to re-punch the hole, eliminate an area of the saw blade's teeth and reform the curved end of the saw blade. This device will also relieve the user of the time consuming and cumbersome task of carrying and using two separate devices. Since the blade repair is often necessarily performed on the job site, a portable, lightweight device is advantageous.

There are numerous, portable hole punching devices in existence. Examples of these devices are disclosed in U.S. Pat. No. 4,729,170, issued in the name of Hartmeister. However, none of these devices perform both the hole punching operation and specific curved end reformation function needed to reattach a reciprocating saw blade to the saw.

There are numerous devices that punch shapes into metal. Bench mounted presses, such as U.S. Pat. No. 3,494,161, issued in the name of Silichev et al., and U.S. Pat. No. 3,468,206, issued in the name of Bakula, are too heavy and bulky to be used on the job site.

Portable material punches, such as U.S. Pat. No. 3,842,650, issued in the name of Hartmeister, and U.S. Pat. No. 5,377,415, issued in the name of Gibson, do not incorporate the very specific punch die needed to create the necessary shape at the end of the saw blade.

Further, the hand-held apparatus disclosed in U.S. Pat. No. 4,336,725, issued in the name of Patterson, is not practical in all applications. There are times when the saw blades are too thick to be cut by a hand-held device.

Patterson cannot be used either as a hand-held press or as a stand-alone press with means for receiving a hammer in instances when it is too difficult to reform the saw blade by hand.

Consequently, a need has been felt for providing an apparatus and method of a lightweight, portable punch press with the capability of being hand-held, used for the repair of broken reciprocating saw blades

SUMMARY OF THE INVENTION

It is therefore an object of the present invention to provide a lightweight, portable, versatile reciprocating blade repair device that performs the hole shaping, teeth eliminating and end reshaping functions necessary to reform the attaching end of the reciprocating saw blade so that the blade can be reattached the reciprocating saw. The attaching end of the reciprocating saw blade is the end that has the attachment hole and is shaped for being received by a reciprocating saw.

In its preferred embodiment, the present invention consists of two handles composed of a strong durable material such as steel, and coated with a pliable material such as plastic, for easy gripping and handling. The lower handle can be mounted onto a base. Located on the top of the lower handle is the steel punch. The punch die is specifically designed to recreate the hole and curved end configuration needed for reattachment of the broken reciprocating saw blade. Since different manufacturers blades may require different specification for the size of the attaching end of the blade. Different corresponding dies are provided. The dies can be removed and replaced as necessary.

It is an object of the present invention to create a device that both reshapes the end and punches the necessary hole in a broken reciprocating saw blade, creating a new attaching end and thus allowing the blade to be reused. This saves the saw user the time, aggravation and expense of having to travel to a store to purchase a new blade. Also, since all the necessary functions of repairing the blade can be done by this one device, it eliminates the need of using multiple tools and is far easier and less cumbersome.

It is a further object of the present invention to create a device that allows the user to reshape the ends of oversized reciprocating saw blades, thus allowing the blade to be used with the saw. This saves time, aggravation and money, since no other blade needs to be purchased.

Furthermore, it is an object of the present invention to create a lightweight, portable, versatile device that allows both hand-held use as well as bench use. This allows the user to carry the device with him or her on the job and make repairs right at the site of the saw blade breakage. No work bench is needed to attach the device.

Finally, it is an object of the present invention to create an easy-to-use reciprocating saw blade reformation device for reforming the attaching end of a reciprocal saw blade. This is accomplished in several ways. The present invention utilizes a punch grip, made from a material such as plastic or foam that provides a sturdy, slip-proof handling of the present invention. Also, the broken or oversized blade fits easily into the opening of the punch base, and is secured there without the use of additional parts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS.

1. Detailed Description of the Figures

Figure 1:
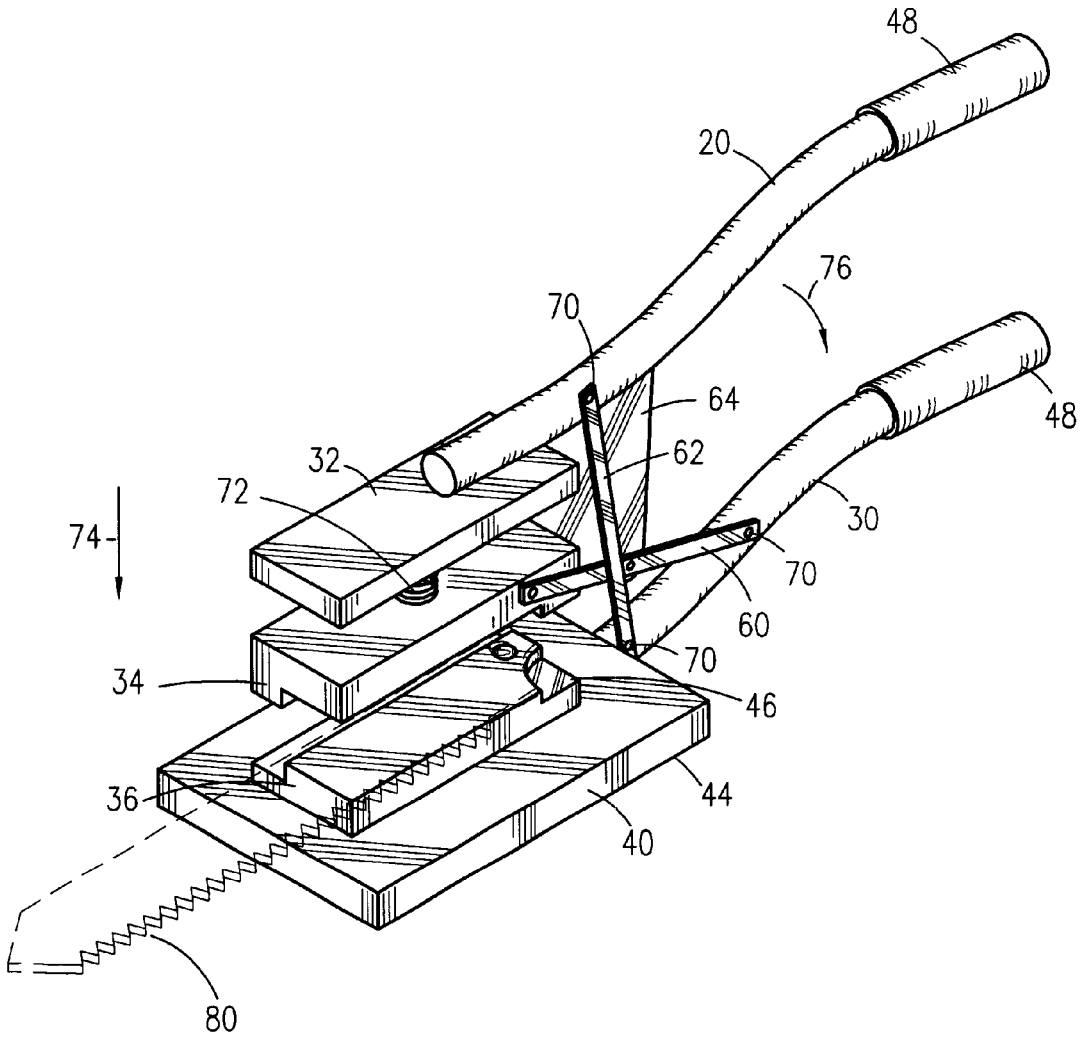
FIG. 1 is a perspective view of the reciprocating saw blade repair device according to the preferred embodiment of the present invention.
Figure 2:
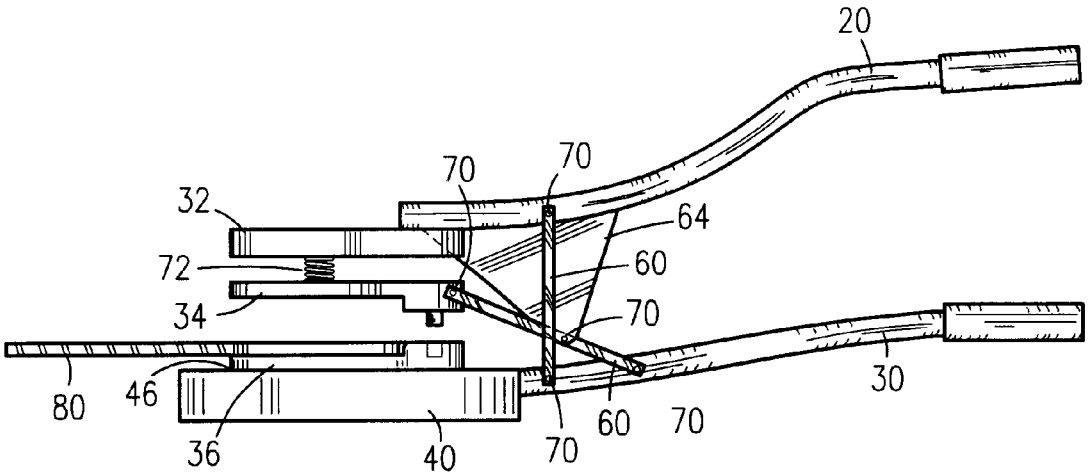
FIG. 2 is a side elevation view thereof.
Figure 3:
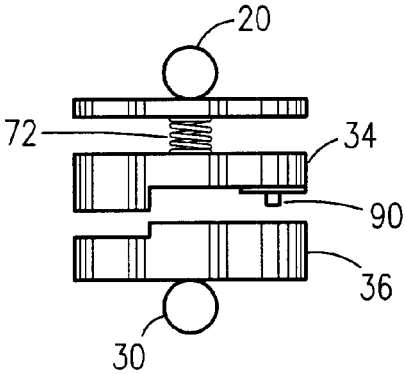
FIG. 3 is a front elevation view thereof.
Figure 7:
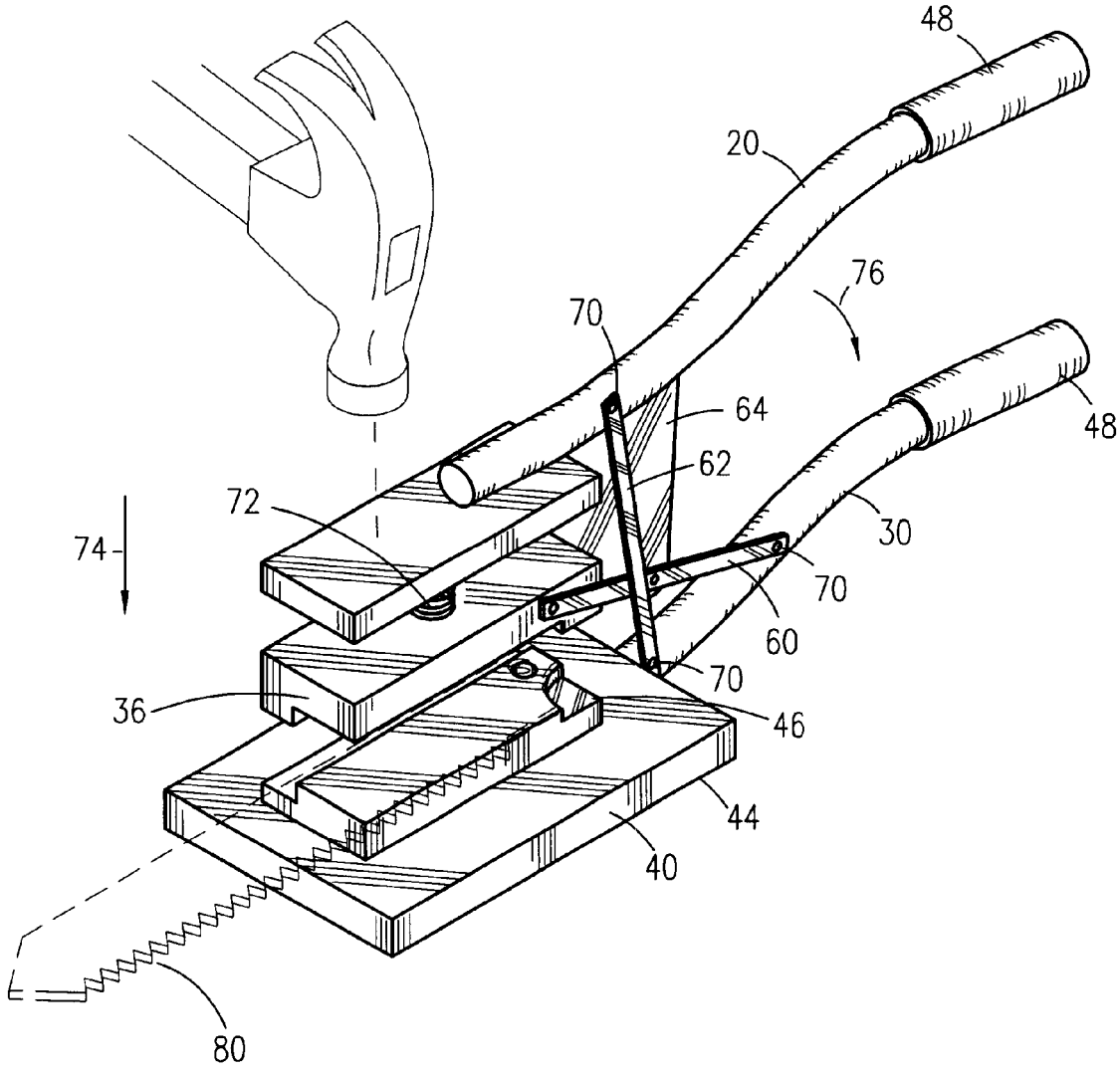
FIG. 7 is a perspective view of the reciprocating saw blade repair device being used with a hammer.

The present invention is a versatile reciprocating blade repair device 10 that can be used in one of three different manners. The device 10 can be used in a hand-held plier-like manner, as detailed in FIG. 4, with the user squeezing together the upper handle 20 and lower handle 30 around the reciprocating saw blade 80, or it can be used, as shown in FIGS. 1, 2 & 3 with the lower handle 30 in the base 40 and the user pressing or pulling down on the upper handle 20 for more force, or if necessary, as shown in FIG. 7 it can be used with the lower handle 30 in the base 40 and the user hitting a hammer against the striking pad 32, for even greater force. This allows for simple hand-held cutting of a thinner reciprocating saw blade 80 while still enabling the user to have only one tool 10 on the premises because it incorporates means for cutting a thicker saw blade 80 that would be impossible to cut with a strictly hand-held device.

In a preferred embodiment, as seen in FIG. 1, the present invention has at least two handles, an upper handle 20 and a lower handle 30, both of which are composed of a strong, durable material, preferably lightweight, such as steel, although one of ordinary skill in the art would readily recognize that the handles 20 & 30 could be composed of a number of other strong, durable materials. Also in a preferred embodiment, the handles 20 & 30 would have handle pads 50 made of a soft, comfortable coating or covering on one end each to comfort the hands of the user when using the device in the hand-held way or when using the device by pressing on the upper handle 20 only. Such a coating or covering is preferred to be plastic or rubber, but is not necessarily so. It is envisioned that the handle pads 50 are of a liquid nature by which the upper handle 20 and/or the lower handle 30 is dipped into and then it is allowed to dry upon the handles 20 & 30. It can be readily recognized by one of ordinary skill in the art, however, that other methods of cushioning such as a tape coating or mechanical means could also be utilized. It can also be readily recognized that only one, both or neither of the handles 20 & 30 can have a handle pad 50.

In a preferred embodiment, the present invention also consists of a base 40, composed of a strong durable material such as steel, although one of ordinary skill in the art would recognize that a number of other materials exist that could be used to compose the base 40. In a preferred embodiment, the base 40 would be substantially wider than the upper and lower handles 20 & 30, to allow stability and balance when using a hammer 82 to aid in the reformation of the broken reciprocating saw blade 80. Also in a preferred embodiment, the base bottom 44 is coated or covered by a non-skid substance 48. Such substances are readily known to those skilled in the art. The top of the base 40 has an aperture 46 for receiving and securing the lower handle 30. In a preferred embodiment, the aperture 46 is just wide enough to fit the lower handle 30 so that the lower handle 30 fits very snug.

In a preferred embodiment, the upper handle 20, pivots around a compound levering system 12 composed of a lower lever arm 60, an upper lever arm 62 and a sliding compound lever 64 which pivot about a set of pivoting means 70, such as a bolt, screw, rivet, pin or other means readily known to one of ordinary skill in the art. Located on the outward end of the lower lever arm 60 is a spring 72 which aids in returning the handles 20 & 30 to their original starting positions, both handles 20 & 30 being away from one another. The spring 72 is of the type readily known to one of ordinary skill in the art. Attached to the bottom of the spring 72 is a removable, replaceable, upper moveable die 34 which moves against a removable, replaceable, lower stationary die 36. Attached to the top of the spring is a striking pad 74. The striking pad is composed of a durable material that can withstand repeated hits from a hammer. In the preferred embodiment, steel is used to construct the striking plate, but one of ordinary skill in the art would recognize that a variety of materials could be used. The compound action of the lower lever arm 60, the upper lever arm 62, the sliding compound lever 64 and the pivoting means 70 allow for magnification of the downward rotational motion 76 applied by the upper handle 20 against the lower handle 30, and in some instances the base 40, to produce a great downward linear motion 74 between the upper moveable die 34 and the lower stationary die 36. This force is used to repair the reciprocating saw blade 80.

Referring now to FIG. 2, depicted more clearly is how the compound action generated by the lower lever arm 60, the upper lever arm 62 and the sliding compound lever 35, is a result of movement of the upper handle 20 against the lower handle 30 and generates a large force on the upper moveable die 34. A pair of punch pins 90 attached to one of the die 34 & 36, seen in FIG. 2, form the alignment holes (not shown) in the reciprocating saw blade 80 by passing through the saw blade 80 and into a pair of punch pin receptor holes 92 cut into the other die 36 & 34. Shown beyond the punch pins 90 is a first shear surface 94 with a function to be described in greater detail hereinbelow.

FIG. 3 depicts a front elevation view of the present invention. In FIG. 3, a broken reciprocating saw blade 80 is shown entering the space between the upper moveable die 34 and the lower stationary die 36. The leading edge of the reciprocating saw blade 80 is positioned such that it extends beyond the first shear surface 94. At this point when the upper moveable die 34 and the lower stationary die 36 are brought together by the compound action of the lower lever arm 60, the upper lever arm 62 and the sliding compound lever 64, the reciprocating saw blade 80 is cut and shaped between the first shear surface 94 and the second shear surface 96. Also the alignment holes (not shown) are punched in the reciprocating saw blade 80 through the action of the pair of punch pins 90 and the corresponding pair of punch pin receptor holes 92.

Figure 4:
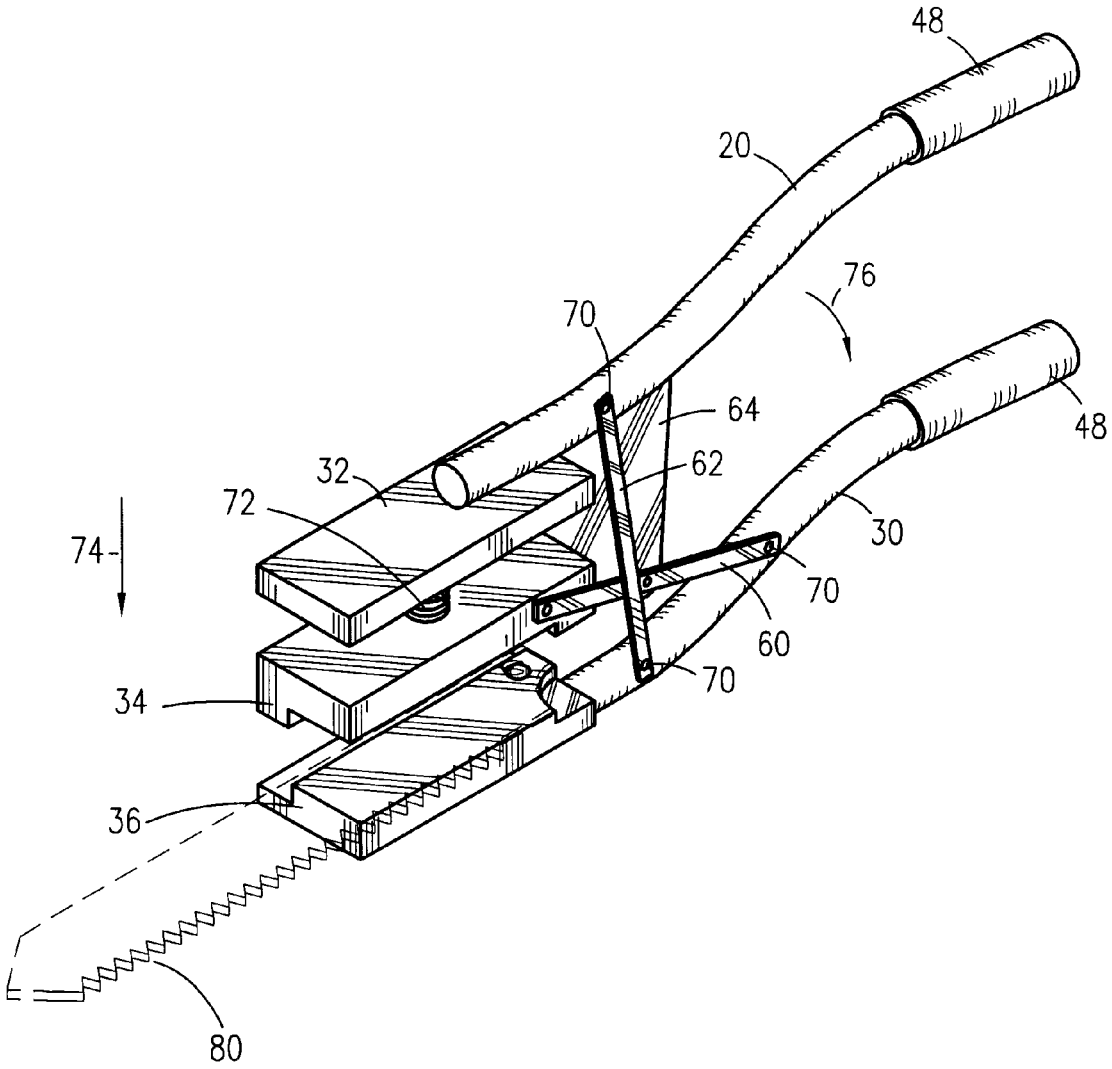
FIG. 4 is a perspective view of the hand-held portion of the reciprocating saw blade repair device removed from the base thereof.

FIG. 4 depicts the upper handle 20 and lower handle 30 together with the levering system 12 without the base 40. Removal from the base allows the user to convert the reciprocating saw blade repair device 10 into a handheld reciprocating saw blade repair device for easier manipulation. The user simply inserts the broken reciprocating saw blade 80 between the upper moveable die 34 and the lower stationary die 36 and squeezes the upper handle 20 and lower handle 30 together thereby forcing the upper moveable die 34 and lower stationary die 36 together over the saw blade 80.

Figure 5:
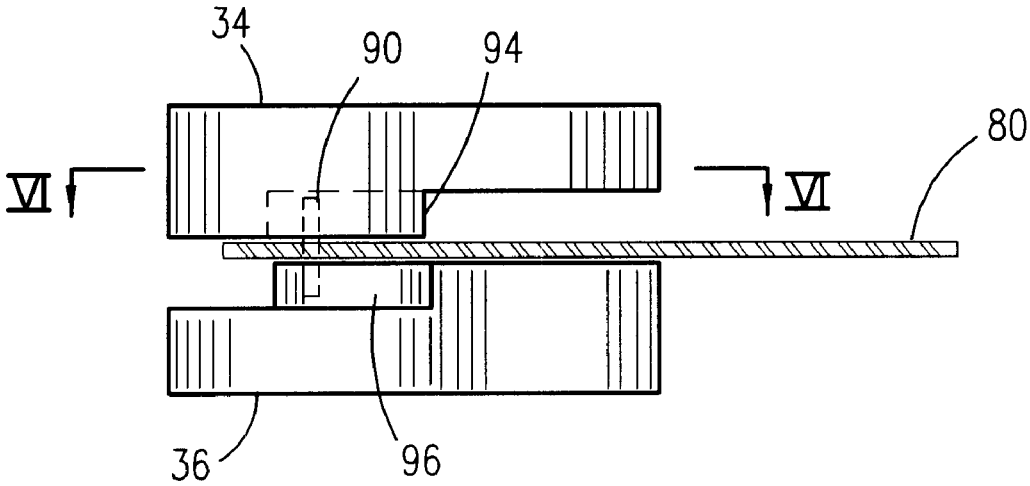
FIG. 5 is a front view of a two-part die for use with the device described in FIG. 1.

FIG. 5 more clearly shows the reciprocating saw blade 70 in its fully seated position between the upper moveable die 34 and the lower stationary die 36. It is also more evident how the mating action of the pair of punch pins 90 with the pair of punch pin receptor holes 92 produces the alignment holes in the reciprocating saw blade 80.

Figure 6:
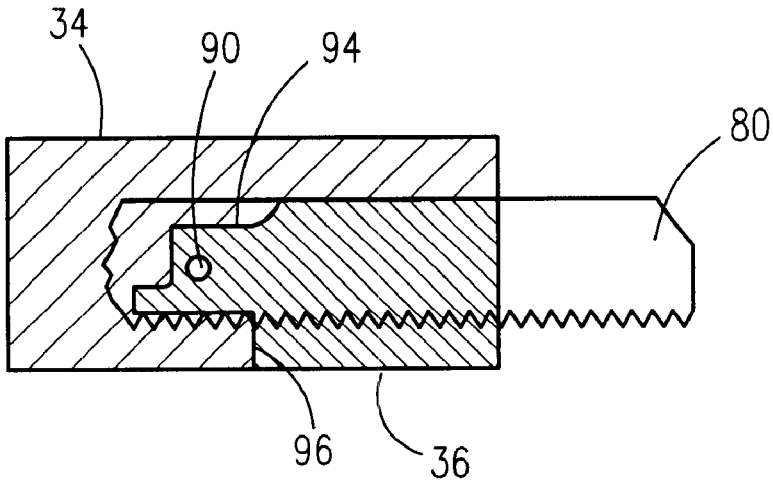
FIG. 6 is a sectional cut view shown taken along line V—V of FIG. 4.

FIG. 6 depicts a sectional cut view taken along line V—V of FIG. 5. The reciprocating saw blade 80 is shown seated upon the lower stationary die 36 with the saw teeth of the broken end (depicted by a dashed line) ready to be sheared by the first shear surface 94 on the upper moveable die 34 against the second shear surface 96 of the lower stationary die 36. It can be seen that this action will result in a reciprocating saw blade 80 with a clean, formed end complete with alignment holes ready to be reinserted into the reciprocating saw. Such action can be repeated upon the same reciprocating saw blade 80 until such time the overall length of the reciprocating saw blade 80 is no longer functional.

FIG. 7 depicts a perspective view of the reciprocating saw blade repair device 10 being used with a hammer 82. In order to shape a thicker blade, more force is needed than just what the user can produce with his hands alone. In such a situation, with the lower handle firmly in the base, and after the broken saw blade has been inserted between the die 34 & 36, the user pushes down on the upper handle 20 with one hand while simultaneously hitting the striking pad 74 with a hammer 82 with the other hand. This allows for the extra force needed to shape the broken saw blade with the die 34 & 36.

2. Operation of the Preferred Embodiment

In its preferred embodiment, the present invention consists of two handles composed of a strong durable material such as steel, and coated with a pliable material such as plastic, for easy gripping and handling. The lower handle can be mounted onto a base. Located on the top of the lower handle is the steel punch. The punch die is specifically designed to recreate the hole and curved end configuration needed for reattachment of the broken reciprocating saw blade. Since different manufacturers blades may require different specification for the size of the attaching end of the blade. Different corresponding dies are provided. The dies can be removed and replaced as necessary.

In the middle of the present invention's lower handles is a small opening for receiving broken or oversized saw blades. The user can use the device in one of three ways: (1) place the broken blade in the opening and squeeze the two handles together; (2) place the handles in the base and press or pull down on the upper handle; or (3) place the handles in the base and use a hammer to pound the striking pad and force the punch down upon the saw blade. User will need to choose the best method given the thickness of the metal that the user wishes to shape. Once the punch has punctured the saw blade, the user can release the lever, returning the punch to its original position, and the blade is ready to be reattached to the reciprocating saw.

The foregoing description is included to illustrate the operation of the preferred embodiment and is not meant to limit the scope of the invention. The scope of the invention is to be limited only by the following claims.

What is claimed is:

1. A reciprocating saw blade repair device comprising:

an upper handle;

a lower handle, said lower handle including a fixed point about which said upper handle moves against, wherein located at an outward end of said lower handle is further a spring having a top and a bottom, for aid in returning the upper handle back to original position; and further attached to the top of said spring is a striking pad for receiving a hit from a hammer;

a compound levering system for pivoting said upper handle, said compound levering system having a lower lever arm, an upper lever arm and a sliding compound lever which pivot about a set of pivoting means;

a base having an aperture for receiving the lower handle; and a die set having one die removably attached to said lower handle and the second die removably attached to the bottom of the spring, said die having opposing faces carrying a cutting die shaped in the form of the attaching end of a reciprocating saw blade.

2. The reciprocating saw blade repair device of claim 1, wherein said upper handle has a handle pad at one end thereof.

3. The reciprocating saw blade repair device of claim 1, wherein both said upper handle and said lower handle has a handle pad at one end thereof.

4. The reciprocating saw blade repair device of claim 1, wherein said base has a top and a bottom and said aperture is located on the top of the base and the bottom of the base has a non-skid surface.

* * * * *